US006854493B2

(12) United States Patent
Ichikawa et al.

(10) Patent No.: US 6,854,493 B2
(45) Date of Patent: Feb. 15, 2005

(54) APPARATUS AND METHOD OF FILLING MICROSCOPIC POWDER

(75) Inventors: Hideo Ichikawa, Numazu (JP); Masanori Rimoto, Mishima (JP); Masakazu Nakada, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/354,084

(22) Filed: Jan. 30, 2003

(65) Prior Publication Data

US 2003/0155035 A1 Aug. 21, 2003

(30) Foreign Application Priority Data

Jan. 30, 2002 (JP) ..... 2002-020980
Nov. 5, 2002 (JP) ..... 2002-320632
Nov. 5, 2002 (JP) ..... 2002-320749

(51) Int. Cl.[7] ..... B65B 1/04

(52) U.S. Cl. ..... 141/301; 141/67; 141/69; 141/83

(58) Field of Search ..... 141/69, 67, 286–302, 141/83

(56) References Cited

U.S. PATENT DOCUMENTS 4,212,331 A * 7/1980 Benatar ..... 141/67
5,489,976 A 2/1996 Ichikawa
5,655,195 A 8/1997 Ichikawa et al.
5,711,353 A 1/1998 Ichikawa et al.
5,727,607 A 3/1998 Ichikawa et al.
5,740,507 A 4/1998 Ichikawa et al.
5,983,059 A 11/1999 Oka et al.
6,088,561 A 7/2000 Kawamura et al.
6,096,374 A 8/2000 Ohta et al.
6,289,195 B1 9/2001 Ichikawa et al.
RE37,542 E 2/2002 Ichikawa et al.
6,403,150 B1 6/2002 Ohta et al.
6,418,293 B2 7/2002 Ichikawa et al.

FOREIGN PATENT DOCUMENTS

JP 09-193902 7/1997

* cited by examiner

*Primary Examiner*—Steven O. Douglas
(74) *Attorney, Agent, or Firm*—Oblon, Spivak, McClelland, Maier & Neustadt, P.C.

(57) ABSTRACT

A powder filling apparatus includes a first container configured to contain a powder. A weighing tank is configured to receive the powder from the first container and discharge a predetermined amount of the powder to a second container, which includes an opening configured to discharge the powder into the second container and a regulator configured to open and close the opening to discharge the predetermined amount of the powder into the second container. A connector is configured to feed the powder from the first container into the weighing tank.

88 Claims, 14 Drawing Sheets

APPARATUS AND METHOD OF FILLING MICROSCOPIC POWDER

BACKGROUND OF THE INVENTION

1. Field of the Invention

The present invention relates to an apparatus and a method of filling a desired amount of a microscopic toner powder for developing an electrostatic latent image into a second container without excess or deficiency from a first container.

2. Discussion of the Background

Conventionally, a powder toner for developing an electrostatic latent image is often filled from a first container into other second containers. For example, Japanese Laid-Open Patent Publication No. 9-193902 discloses a method of filling a toner powder into a toner receiving container from a toner feeding container equipped with an auger inside for stirring the toner and a rotary valve at the bottom. The method includes a process of increasing fluidity of the toner by feeding air into the toner stirred in the toner feeding container and a process of feeding the toner into the toner receiving container through a feeding tube and compressing the toner to fill the toner therein in the high density, wherein an exhaust tube for circulation located between the toner feeding container and the feeding tube separates the air from the toner and circulates the air including the toner into the toner feeding container.

A toner for developing an electrostatic latent image is a powder having an extremely small particle diameter and has less fluidity than other powders such as ceramic materials in spite of having a lower specific gravity than such other powders, and has a relatively high agglutinability. Recently, smaller particle diameters are required to comply with demands for a high-resolution image, and a lower-temperature melting resin is required to comply with demands for saving energy and an instant high-speed fixation. However, use of such particles results in problems of agglomeration, adherence to and filming of the toner over a surface of the other materials. Accordingly, in order to improve these properties and avoid the fluidity deterioration and agglomeration, in many cases, ultra-fine particles such as a fluidity improver, an agglomeration inhibitor and a charge controlling agent to improve chargeability of the toner are applied to a surface of the toner. Therefore, in terms of preventing these ultra-fine particles from separating and releasing from the toner and maintaining the chargeability, fluidity and agglomeration resistance thereof, it is not desirable that the toner is stirred or fed by means of an auger or a screw conveyor giving an excessive stress thereto.

Particularly, a color toner has a small particle diameter, and includes a charge controlling agent, a fluidizer, an agglomeration inhibitor and a fusion inhibitor on a surface thereof. Therefore, the color toner has poor fluidity because the particles intertangle each other, and it is not desirable to use a conventional mechanical apparatus such as a rotary valve and an auger since a strong external force applied to the toner involves the risk of impairing the properties thereof.

When a toner and air are mixed to make the toner pneumatic, a toner cloud (a nebula toner formed from a mixture of a toner and air) having floating ultra-microscopic toner is formed and a volume of the toner increases. It is difficult to quickly separate air from the toner cloud only by a structure and a location of a separation tube, and therefore it is difficult to control a compressed amount of the toner by an air separation from the toner cloud using such a tube. When air is supplied to the extremely microscopic toner, a flowing phase thereof increases quickly and easily changes to a dust phase, and it takes time to collect the toner from the dust phase and the dust contaminates the circumference. Once a toner cloud is formed, it takes up to several hours for the toner to fall onto the bottom by itself. It is not easy to fluidize the accumulated toner and fill it into a second container while moderately feeding air to prevent formation of a large toner cloud.

In addition, when the toner is distributed from a first storage container into many second containers, the toner in the second containers occasionally has an irregular ingredient due to the air fed into the storage container.

Because of these reasons, a need exists for an apparatus and a method of fluidizing a toner stored in a first container, and quickly and precisely distributing the toner into a small container without impairing the toner properties and composition and contaminating the circumference, which is easily automated and has good manageability.

SUMMARY OF THE INVENTION

Accordingly, an object of the present invention is to provide an apparatus and a method of quickly filling a desired amount of a toner into a second container without giving a particular stress thereto, contaminating the environment and/or exposing an operator to danger.

Another object of the present invention is to provide a technology which can be used for a toner feeder on a production line as well as in a distribution of the toner from a temporary storage container, and which can be used by an end-user to fill the toner into a second container on-demand.

Briefly these objects and other objects of the present invention as hereinafter will become more readily apparent can be attained by a powder filling apparatus including a first container configured to contain a powder. A weighing tank is configured to receive the powder from the first container and discharge a predetermined amount of the powder to a second container, which includes an opening configured to discharge the powder into the second container and a regulator configured to open and close the opening to discharge the predetermined amount of the powder into the second container. A connector is configured to feed the powder from the first container into the weighing tank.

In addition, the regulator of the powder filling apparatus can preferably perform at least three levels of discharging including freely discharging, stopping discharging and partially discharging the powder. Further, the weighing tank of the powder filling apparatus can include a powder fluidizer to fluidize the powder fed from the weighing tank to the second container through the opening.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
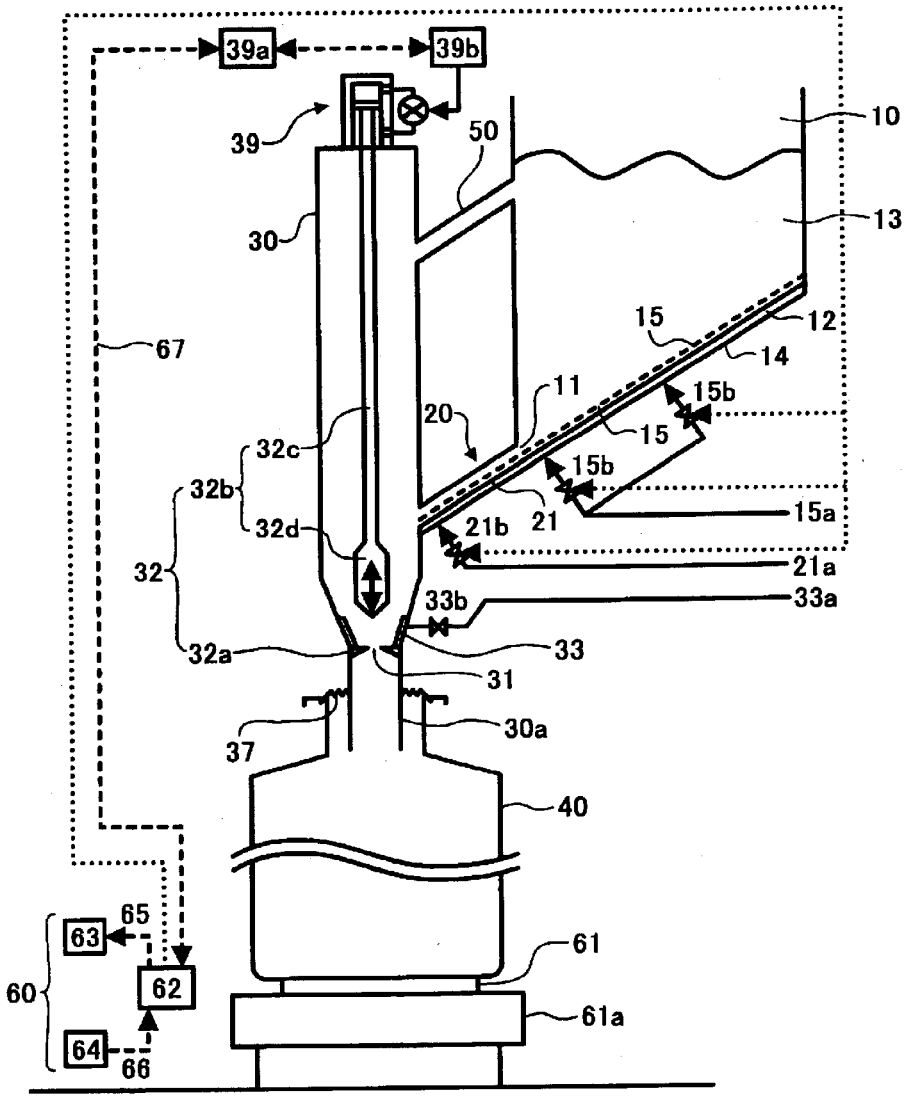
FIG. 1 is a schematic view illustrating the cross section of an embodiment of the filling apparatus of the present invention.

The present invention includes an apparatus and a method which can prevent problems when a second container is directly filled with a toner from a first container containing or storing the microscopic toner powder. It is difficult to constantly discharge a certain amount of the toner from the first container without giving a stress to the toner because the microscopic toner powder has a peculiar fluidity. In addition, it is difficult to precisely fill the second container with a desired amount of the toner by strongly and weakly discharging the toner, temporarily stopping discharging or discharging in drops. Further, it may be necessary to change the discharge amount of the toner, e.g., when the discharge amount comes close to a predetermined filling amount of the second container, and the discharge amount is often controlled while seeing whether the amount reaches the predetermined amount or estimating when the amount reaches the predetermined amount. The filling method of the present invention can quickly, easily and precisely fill a container.

In the present invention, a toner can be discharged into a weighing tank from a first container and a desired amount of the toner can be filled in a second container by the weighing tank. However, as mentioned later, the weighing tank does not necessarily fill the second container with the toner after the toner is discharged into the weighing tank from the first container. The weighing tank can fill the second container with the toner almost simultaneously when the toner is discharged into the weighing tank from the first container.

In the present invention, the discharge from the first container into the weighing tank is suitable for a quick discharge of a large amount of the toner and the filling from the weighing tank into the second container is suitable for filling a precise desired amount of the toner, and accordingly a combination of both discharges improves the filling operation. It can be considered that the toner is discharged from a first container into a second weighing container having a capacity of a filing amount unit. A desired amount of the toner can be filled by filling amount regulator. Although the first container and the weighing tank of the present invention do not always work in a good timing, which is not necessarily indispensable, the filling amount regulator having a precise structure and performance in the weighing tank smoothly and precisely filling the second container with a desired amount of the toner can not only have the first container and the weighing tank work in a good timing but also quickly fill the second container with the toner.

Further, when first toner fluidizer and the filling amount regulator in the weighing tank work together, the toner can more quickly and precisely be filled. In addition, controlling a feeding amount of air from the first toner fluidizer can control the filling amount of the toner into the second container. Thus, the toner can smoothly be filled without imparting a mechanical stress thereto.

In the present invention, the first container preferably has a sloped bottom surface and a third toner fluidizer feeding air thereon to slightly inflate or float a powder toner filled in the container, promote falling of the toner to a toner discharge opening on the bottom, and smooth a discharge of the toner therefrom without imparting a mechanical stress to the toner. In addition, by controlling a feeding amount of the air from the third toner fluidizer, a discharge amount of the toner from the first container into the weighing tank can be controlled and/or the discharge of the toner can be stopped. Such a construction prevents the toner from accumulating and/or agglutinating on an inside surface of the container to prevent an intermittent discharge of the toner, and prevents the toner from densely accumulating on the toner discharge opening on the bottom to smooth the discharge of the toner into the weighing tank.

The first container and the weighing tank are not necessarily unified and the toner discharged from the first container is preferably fed into the weighing tank through a connector which is a contact route between the first container and the weighing tank. The connector preferably has second toner fluidizer and controls a feeding amount of air therefrom to prevent the toner particles from crosslinking in the connector to control a discharge amount of the toner therethrough into the weighing tank and/or to stop feeding air to stop discharging the toner. In addition, a pressure controller controlling an inside air pressure can optionally be arranged either in the first container or the weighing tank.

In addition, in order to aspirate air in the second container to prevent a toner cloud (a nebula toner formed from a mixture of a toner and air) having a floating toner therein, a suction tube can be inserted into the second container to aspirate only the air without passing the filled toner particles therethrough.

The present invention preferably has a filled toner weight controller controlling a filled amount of the powder toner into the second container, which can be, e.g., a conventional load cell weighing an article loaded thereon and having a monitor displaying a weight of the article.

In addition, the present invention can optionally be arranged such that the filled toner weight controller can smoothly work based on the toner weight weighed by the load cell and the feeding amount of air from the first or third toner fluidizer. Further, a control signal for that purpose can be sent from a central processing apparatus and a timing to send the signal can be computed. The central processing apparatus can have input device giving an instruction or a change instruction thereto to fix a required filling amount and/or change the filling amount.

Hereinafter, examples of the present invention will be specifically explained based on the drawings.

FIG. 1 is a schematic view illustrating the cross section of an embodiment of the filling apparatus of the present invention.

In the filling apparatus of FIG. 1, a microscopic powder toner in a first container 10 is filled into a second container 40 through a weighing tank 30. The first container 10 and the weighing tank 30 are connected to each other with a connector 20 between a toner discharge opening 11 and a toner entrance of the weighing tank 30. The weighing tank 30 has a filling amount regulator 32 filling the second container 40 with a predetermined amount of the toner at a toner discharge opening 31 thereof while opening and closing the opening 31.

The first container 10 has a sloped inner wall 12 to aid in a discharge of the toner stored inside to the toner discharge opening 11. In this embodiment, the slope inner wall 12 is a part of a hopper-shaped construction 13 of the first container 10.

Figure 2:
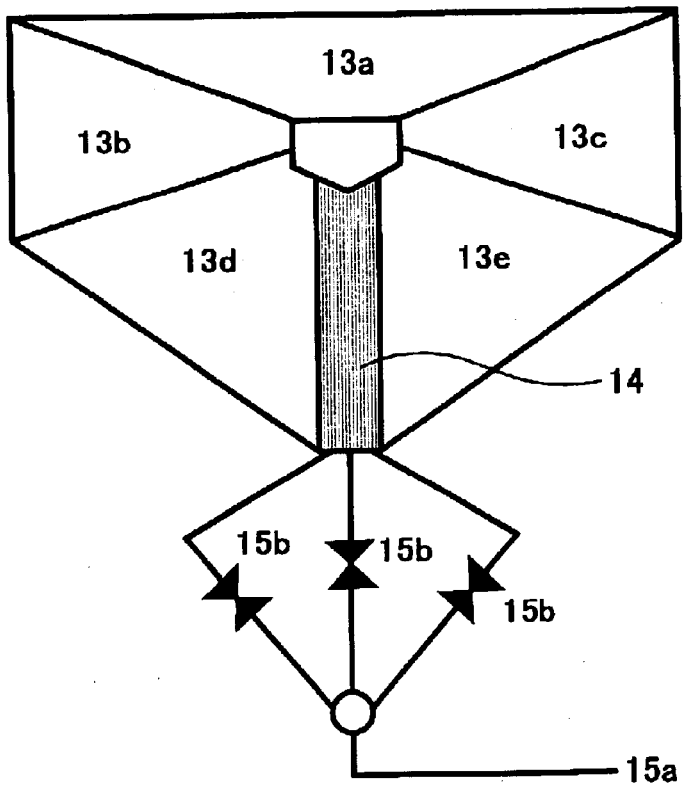
FIG. 2 is a schematic view illustrating the cross section of the first container in FIG. 1.

As shown in FIG. 2, the hopper-shaped construction 13 of the first container 10 includes a vertical base plate 13*a*, rough triangle side plates 13*b* and 13*c* inclined inside on both sides of the vertical base plate 13*a*, and rough triangle back plates 13*d* and 13*e* inclined inside facing the vertical base plate 13*a*. The hopper-shaped construction 13 has a cross section of an inverted trapezoid and a shape of a square-built teepee type having a downslope (e.g., a pyramid with a pentagonal base). A joined valley portion 14 between the back plates 13*d* and 13*e* includes a third toner fluidizer 15 fluidizing the toner to promote falling of the microscopic powder toner. A third air lead-in tube 15*a* for the third toner fluidizer 15 includes 3 branches on the bottom and both walls of the valley portion 14, and each branch has an air feeding control valve 15*b*.

A first toner fluidizer 33 located in the weighing tank 30 and/or a second toner fluidizer located in the connector 20 can prevent an interruption of the toner feeding and/or falling of the toner in drops. In addition, controlling an amount of feeding air can control a feeding amount of the toner and a size of a toner cloud (a nebula toner formed from a mixture of a toner and air) having a floating ultra-microscopic toner.

The first container 10 and the weighing tank 30 are connected to each other with an upper connector 50 above the connector 20, which has a slope upward from the weighing tank 30 to the first container 10. The upper connector 50 keeps a pressure in the weighing tank 30 equal to that of the first container 10, and when a larger toner cloud than desired) for example, caused by providing too large an amount of the air from the first toner fluidizer 33) is formed, the excessive air can be extracted from the weighing tank 30 into the first container 10 through the upper connector 50. Since the upper connector 50 has a slope upward, the toner accompanied with the air can be returned into the weighing tank 30.

The toner powder discharged from the toner discharge opening 11 on the bottom of the first container 10 passes through the connector 20 into the weighing tank 30. The connector has an air slider formed of a perforated plate, i.e., the second toner fluidizer 21 at least on the bottom surface, which feeds air almost all over the surface in the long direction. The air fed from the second toner fluidizer 21 fluidizes the toner fed through the connector 20 into the weighing tank 30. The connector has a slope downward to the weighing tank 30 and helps the fluidized toner falling into the weighing tank 30.

The toner powder discharged from the toner discharge opening 11 is fed into the weighing tank 30 through the connector 20. The weighing tank 30 in this embodiment has the filling amount regulator 32 at the toner discharge opening 31 to precisely and smoothly fill a desired amount of the toner.

The filling amount regulator 32 in this embodiment is formed of an elastic ring 32*a* forming the discharge opening 31 and a discharge controller 32*b* controlling discharge of the toner from the discharge opening 31. The discharge controller 32*b* is formed of a discharge control member 32*d* fixed on a discharge control rod 32*c* reciprocating in the weighing tank 30. The discharge control member 32*d* is a conical member inserted into and released from the discharge opening 31 to open and close the discharge opening 31. An opening and closing degree of the discharge opening 31 depends on an inserting degree of the conical discharge control member 32*d* fixed on the discharge control rod 32*c* reciprocating in the weighing tank 30 into the discharge opening 31 formed by the elastic ring 32*a*.

When a conical tip having a small diameter of the discharge control member 32*d* ascends until the tip is completely released from the discharge opening 31, the discharge opening 31 is fully opened, i.e., the toner is freely discharged. When a root of the conical discharge control member 32*d* having a large diameter descends until the root is completely inserted into the discharge opening 31, the discharge opening 31 is completely closed, i.e., the toner discharge stops. When the conical discharge control member 32*d* is not completely released from the discharge opening 31 and not completely inserted thereinto, i.e., when the member is inserted thereinto such that there is a clearance between the member and the opening, the discharge opening 31 is half or partially opened according to the insert level, i.e., the toner is partially discharged. A flexible covering member 37 is located on a sleeve 30*a* of the discharge opening 31, however this covering member 37 can be omitted.

As shown in FIG. 1, the closer to the discharge opening 31, the thinner the thickness of the elastic ring 32*a* having a wedge-shaped cross section. The thinner part of the elastic ring 32*a*, which has more flexibility, contacts the discharge control member 32*d* when completely inserted thereinto. The elastic ring 32*a* does not cause toner to film over a surface of the elastic ring 32*a* and the discharge control member 32*d*. It is thought that a stress is scarcely given to the toner inevitably remained between the elastic ring 32*a* and the discharge control member 32*d* even when they are contacted to each other.

However, the filling amount regulator at the discharge opening 31 in the weighing tank 30 is not required. For example, the discharge opening 31 can be formed of an elastic material and a plate member can be used as an openness regulation member, which is adjacent to the discharge opening 31 and slides ahead and backward in plane direction. In addition, a relative location between the discharge opening 31 and a movable member having an opening conformed to the opening of the discharge opening 31 can control the openness.

A drive unit 39 driven by a driving source 39*b* controlled by a driving control apparatus 39*a* reciprocates the discharge rod 32*c*. An air pressure cylinder, a motor, a hydraulic cylinder, etc. can be used as the drive unit 39. An air pressure cylinder is used in this embodiment. A source piping for a compressed air used for the first toner fluidizer 33, the second toner fluidizer 21 and the third toner fluidizer 15 can distribute the compressed air to the driving source 39*b* to drive the drive unit 39.

The first toner fluidizer 33 has one or more pores discharging air and a first air lead-in tube 33*a* leading the compressed air into a porous material disposed therein. Similarly, the second toner fluidizer 21 has one or more pores discharging air and a second air lead-in tube 21*a* leading the compressed air into a porous material disposed therein, and the third toner fluidizer 15 has one or more pores discharging air and a third air lead-in tube 15*a* leading the compressed air into a porous material disposed therein. In this embodiment, a porous sinter having a smooth surface is used. In addition, this embodiment of the powder filling apparatus has a discharger (not shown) to eliminate static electricity to prevent a toner dust explosion.

As shown in FIG. 1, the first toner fluidizer 33 is formed in a whole circumference close to the discharge opening 31 in the weighing tank 30 to obtain a desired toner dischargeability, which is different from the third toner fluidizer 15 in the first container 10. A moving amount of the toner powder has a range in proportion to a feeding amount of air, and the moving amount of the toner can be adjusted by controlling the feeding amount of air. However, when a similar air discharging material is used, an area size of each toner fluidizer 33, 21 and 15, i.e., the number of holes of each toner fluidizer largely depends on an available amount of the air. Particularly, the weighing tank 30 having a smaller cross section toward the discharge opening 31 can circumferentially have several continuous stages of air feeding opening or have such a feeding structure as can feed air in spiral direction.

The first air lead-in tube 33*a* has a first air feeding control valve 33*b* positionable to stop feeding air, start feeding air and control an amount of the feeding air. Similarly, the second air lead-in tube 21*a* has a second air feeding control valve 21*b* positionable to stop feeding air, start feeding air and control an amount of the feeding air, and the third air lead-in tube 15*a* has a third air feeding control valve 15*b* positionable to stop feeding air, start feeding air and control an amount of the feeding air. However, in the present invention, at least one of the air lead-in tubes 33*a*, 21*a* and 15*a* preferably has such an air feeding control valve.

Figure 5:
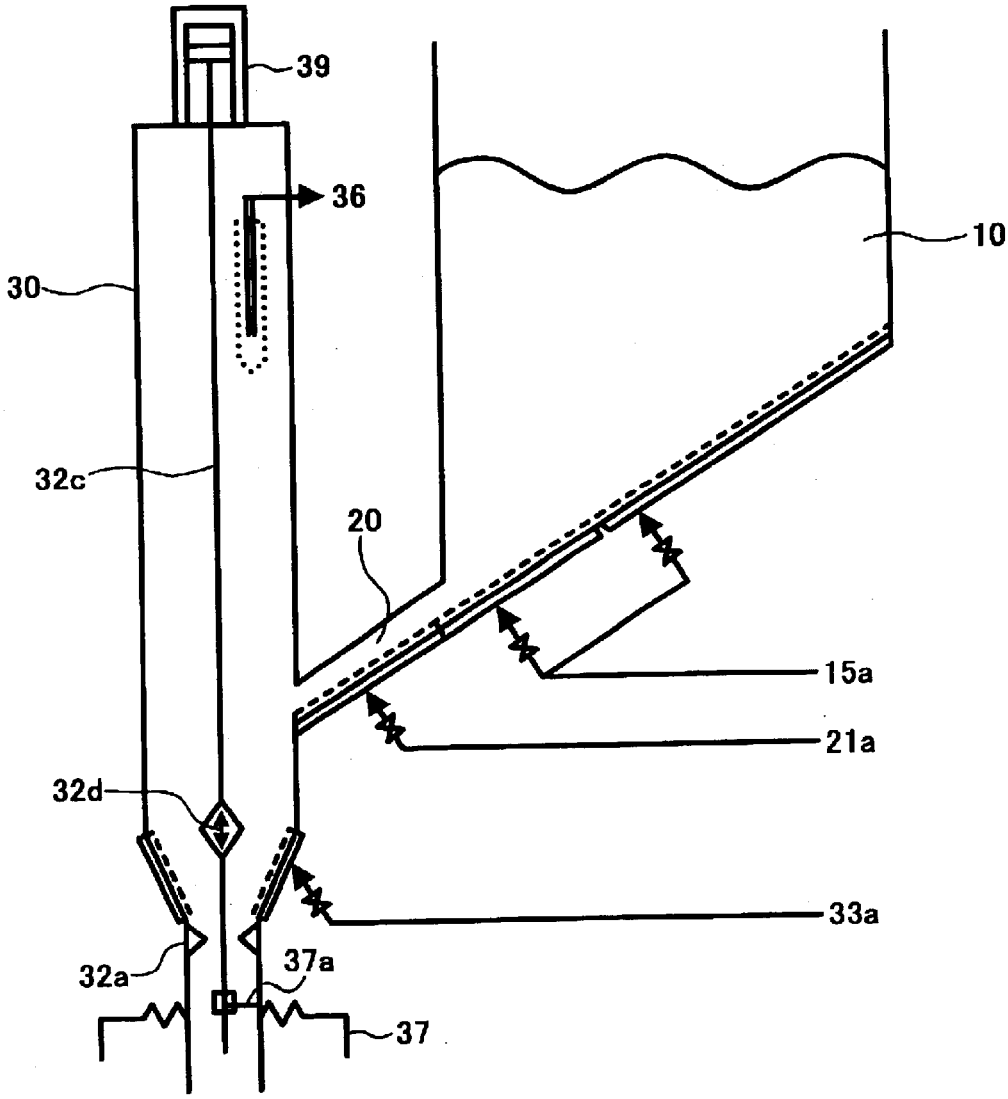
FIG. 5 is a schematic view illustrating the cross section of another embodiment of the filling apparatus of the present invention.

In addition, as shown in FIG. 5, the weighing tank 30 of the filling apparatus of the present invention can have a pressure controller 36 increasing and decreasing an inside pressure. The first container 10 can have such pressure controller instead of the weighing tank 30 or together therewith. Such a pressure controller controls an inside pressure and/or a toner cloud in the first container 10 and/or the weighing tank 30 into which air is fed from the above-mentioned first to third toner fluidizers.

Further, the filling apparatus of the present invention can include a suction tube inserted into the second container to extract air therein filled with the toner.

Figure 3:
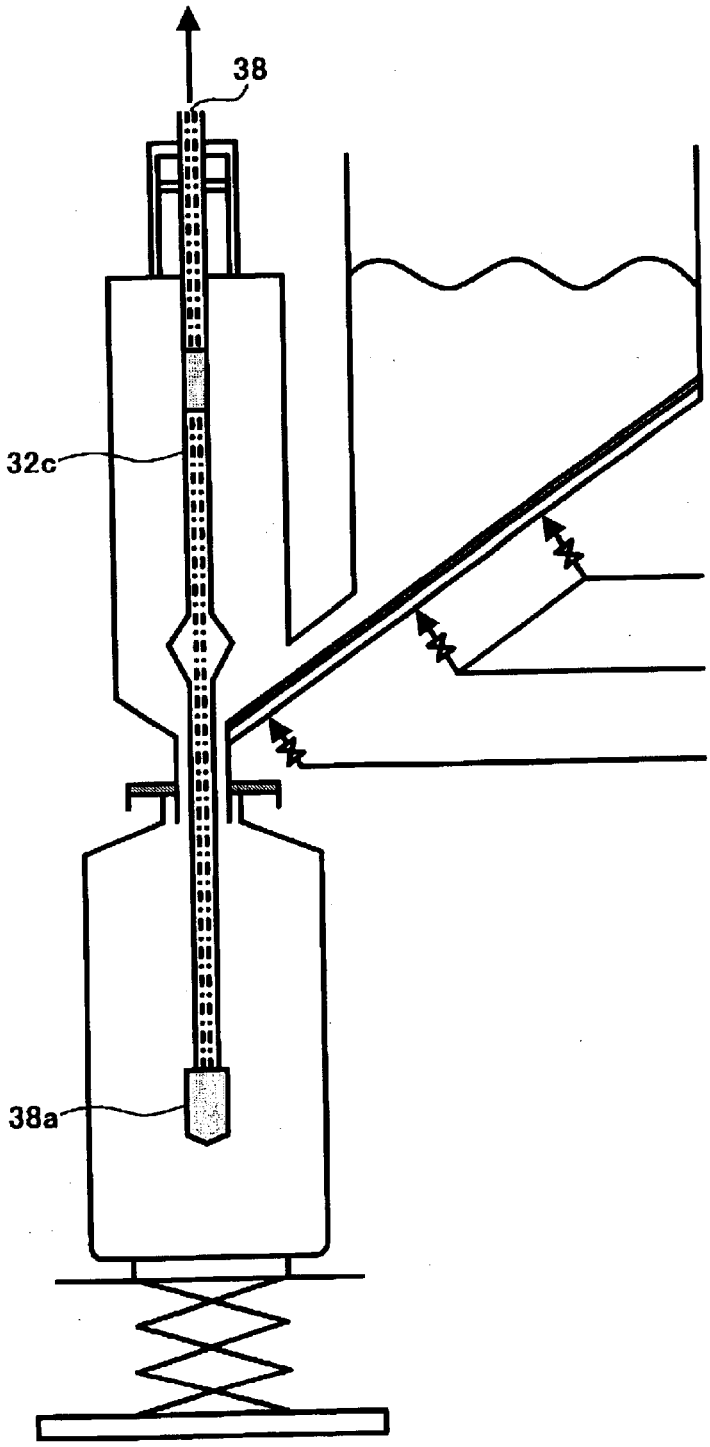
FIG. 3 is a schematic view illustrating the cross section of another embodiment of the filling apparatus of the present invention.

As shown in FIG. 3, the hollow discharge control rod 32*c* inserts a suction tube 38 into the second container 40 from the hollow portion and extracts air therein from the tip of the tube. The insert opening tip of the suction tube 38 has a mesh 38*a* through which air, but not toner particles, can pass. Such a double structure can prevent a vibration of the suction tube 38 or a noise due to the vibration. Further, in order to prevent a resonance between the hollow discharge control rod 32*c* and the suction tube 38 inserted therein, a resonance inhibitor can be disposed at a desired part of a clearance therebetween, which can also be used as a fixer fixing the double structure formed of the hollow discharge control rod 32*c* and the suction tube 38 inserted therein.

Figure 4:
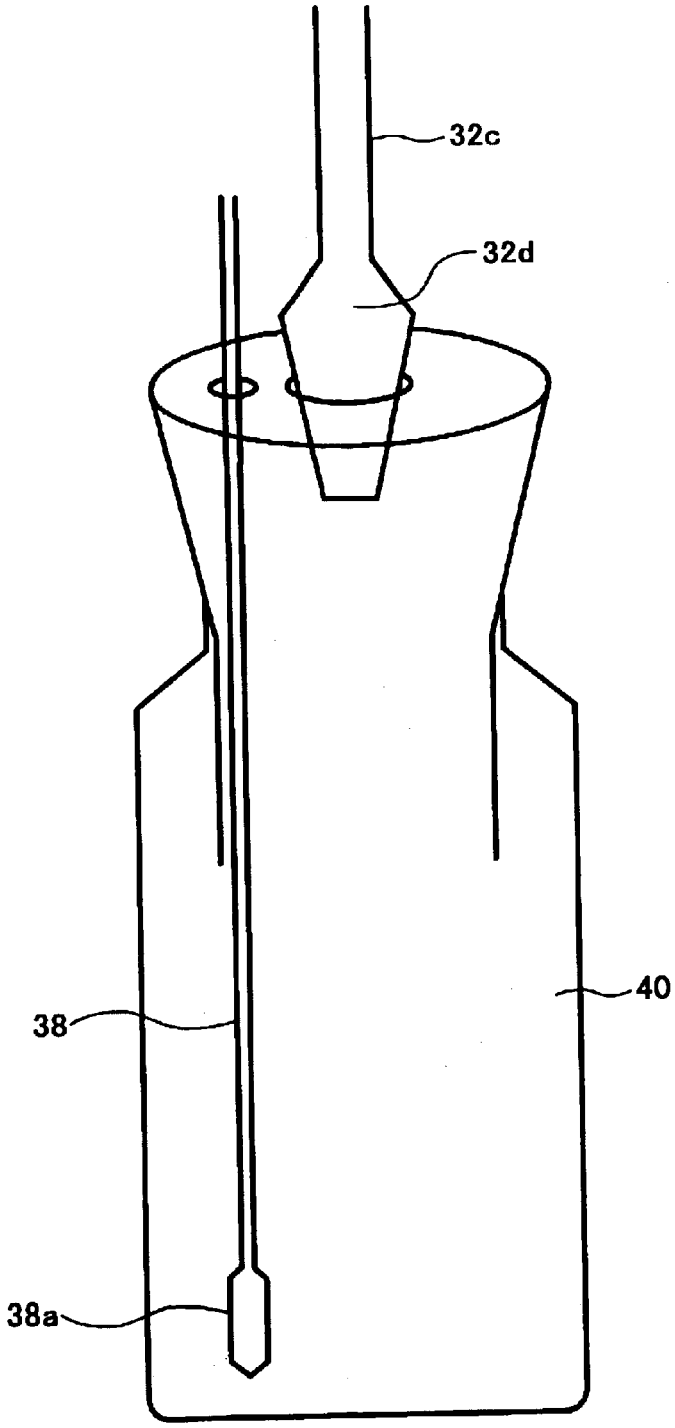
FIG. 4 is a schematic view illustrating the cross section of another embodiment of the filling apparatus of the present invention.

In addition, as shown in FIG. 4, the suction tube 38 can be inserted into the second container 40 from a location which is different from the discharge control rod 32*c* and extract the air in the second container from the tip. The toner filing apparatus having such a separated structure can flexibly be produced without requiring strict precision of the size. In addition, the powder filling apparatus preferably has a filled toner weigher weighing the filled powder toner in the second container 40, and the filled toner weigher 60 in this embodiment has a load cell 61 weighing the filled toner weight in the second container 40 thereon. The load cell 61 is located on a lifter 61*a* changing a distance between the weighing tank 30 and the second container 40 while lifting and lowering the load cell. The load cell 61 has a monitor 63 displaying a weight of the filled powder toner.

As such a monitor, known displays such as pressure detectors detecting a voltage changed according to an elastic deformation degree due to a weight or a pressure, or a pressure detection device such as a piezoelectric device directly changing an electromotive force according to a pressure, can be used. Filling or stopping filling the toner can be made while seeing a filled amount (weight) of the toner displayed on the monitor 63.

The filled toner weigher 60 optionally has a processor 62 computing the filled toner weight from a difference between an empty weight of the second container 40 and a gross weight thereof filled with the toner.

The processor 62 has an input device 64 to which a predetermined filling weight of the toner can be input and can change the predetermined filling weight thereof while seeing the weight displayed on the monitor 63. In addition, the processor 62 sends a drive instruction signal to the driving control apparatus 39*a* controlling the driving source 39*b* of the driving apparatus 39 based on a result of the computation, and the driving control apparatus 39*a* reciprocates the discharge control rod 32*c* based on the instruction. The processor 62 can include various CPUs from a simple analog voltage comparator to a microcomputer chip. When the analog voltage comparator is used, an AD converter converts an analog signal into a digital signal, e.g., a pulse signal corresponding to a difference of a predetermined potential.

As mentioned above, when a conical tip having a small diameter of the discharge control member 32*d* of the discharge control rod 32*c* ascends until the tip is completely released from the discharge opening 31, the discharge opening 31 is fully opened. When a root of the conical discharge control member 32*d* having a large diameter descends until the root is completely inserted into the discharge opening 31, the discharge opening 31 is completely closed. When the conical discharge control member 32*d* is not completely released from the discharge opening 31 and not completely inserted thereinto, i.e., when the member is inserted thereinto such that there is a clearance between the member and the opening, the discharge opening 31 is half or partially opened according to the insert level. Therefore, it can be adjusted to provide any level. However, the discharge control rod 32*c* of the embodiment of the powder filling apparatus shown in FIG. 1 has three reciprocation degrees, i.e., a completely closed degree, a fully opened degree and a half or partially opened degree which is in the middle therebetween since controlling an amount of feeding air to the first to third air lead-in tubes 33*a*, 21*a* and 15*a* also can control filling the powder.

Figure 6:
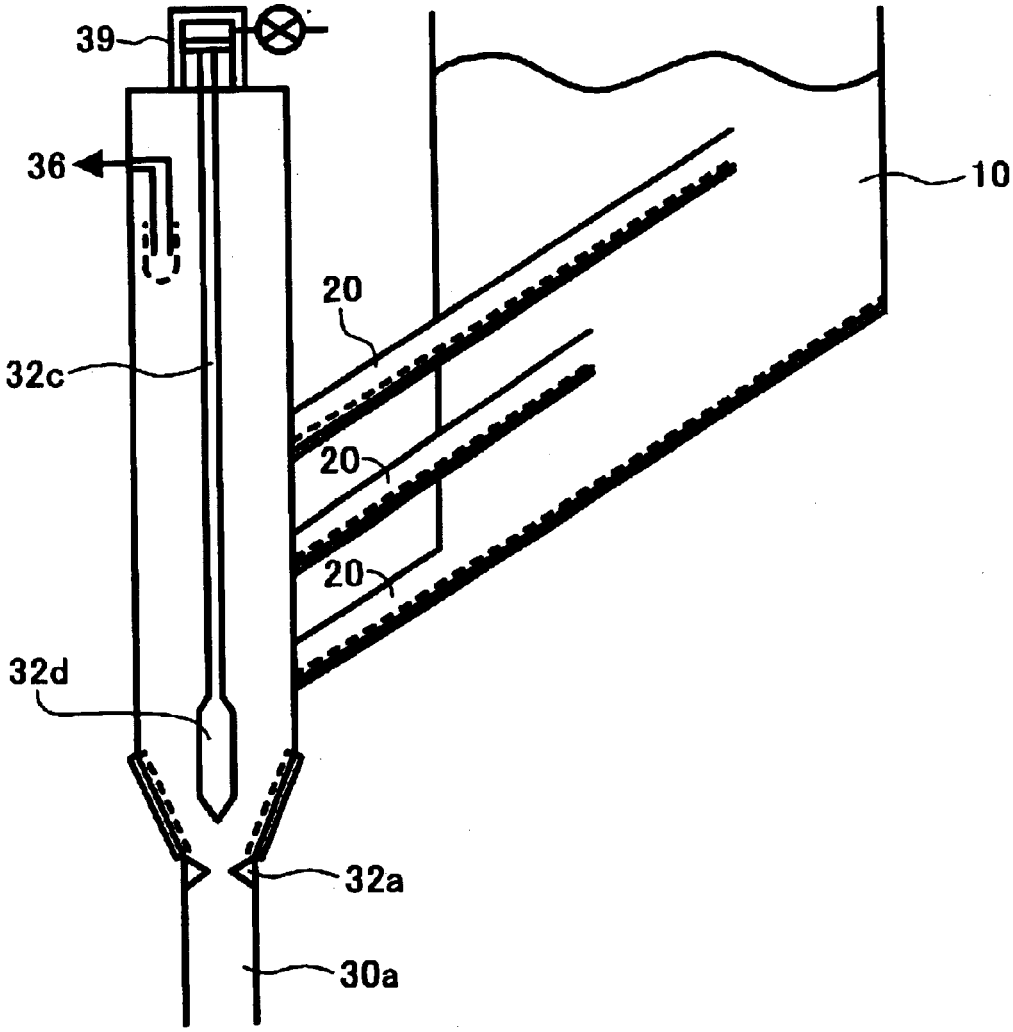
FIG. 6 is a schematic view illustrating the cross section of another embodiment of the filling apparatus of the present invention.

The input device 64 in this embodiment is a button-and-dial digital switch as a (binary) code generator. When the processor 62 is a CPU with a keyboard, a RAM rewritably storing various data including a weight based on a result of the computation and/or an input signal from the input device, i.e., calling the data in the CPU, computing and storing again a result of the computation and a ROM storing various programs including a processing program for processing the data and various instructing programs can be installed in the processor 62. Then, the processor 62 can be configured, e.g., so as to have a program sending an opening and closing instruction to the first to third air feeding control valves 33*b*, 21*b* and 15*b*. In addition, as shown in FIG. 6, the powder filling apparatus of the present invention can have plural connectors connecting the first container 10 with the weighing tank 30, the openings of which feed not in original microscopic powder into a filling cylinder from different locations of the first container respectively. Further, one of the connectors can be a pressure control member keeping a pressure of an upper space of the weighing tank 30 not greater than an ambient pressure.

Figure 7:
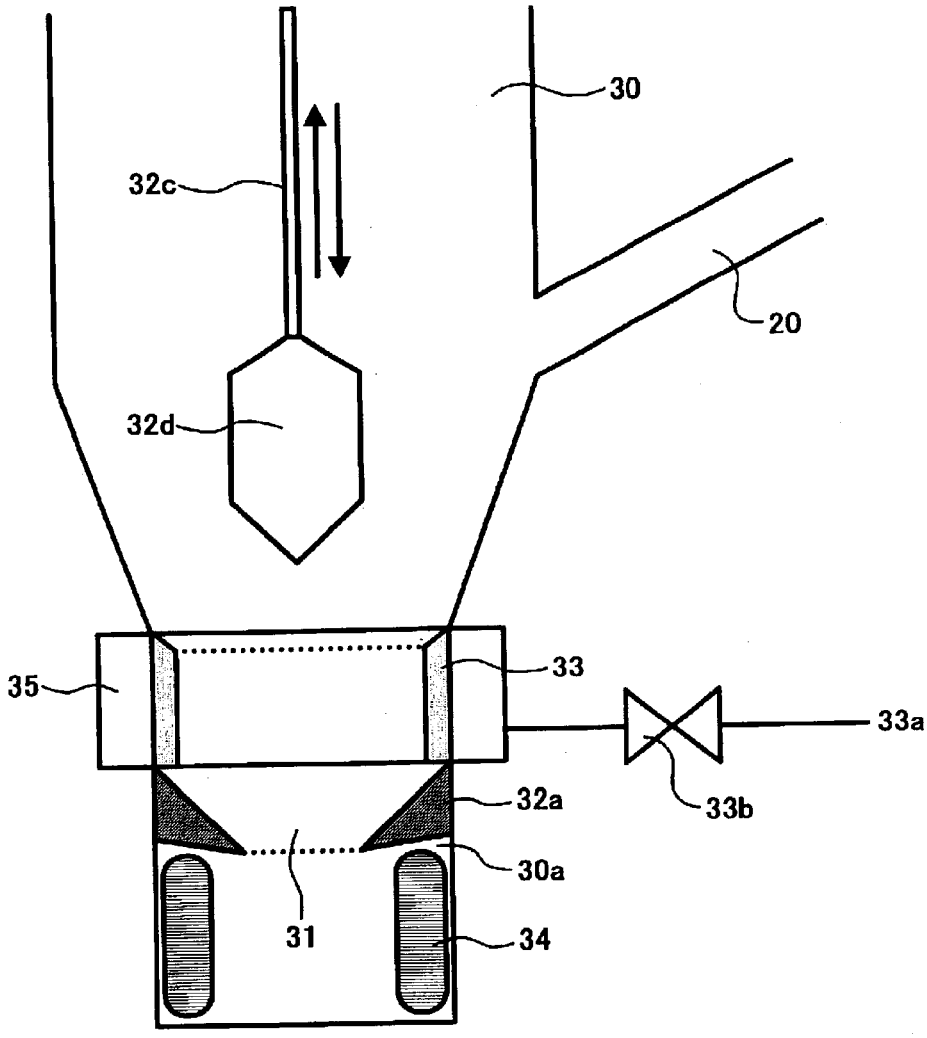
FIG. 7 is a schematic view illustrating the cross section of another embodiment of the filling apparatus of the present invention.

As shown in FIG. 7, the elastic ring 32*a* in the powder filling apparatus has a steep slope at the upper part and a gentle or shallow slope at the bottom, and a thinner thickness from the periphery toward the discharge opening 31, to prevent the toner from adhering to a surface thereof. Suction means 34 can be located at a periphery of the sleeve 30*a*, which does not have the discharge opening 31 of the elastic ring 32*a*. In addition, a distributor for feeding air 35 uniformly distributing air to the first toner fluidizer 33 can also be located.

In the filling apparatus of the present invention, when an accumulated amount of the toner at the discharge opening of the first container increases and passing speed of the toner powder in the connector decreases due to an increased air resistance, the toner feed automatically stops in some cases. Although fluidizing the toner prevents this, an inflation degree of the toner layer increase in volume of the toner cloud by feeding air into the first container is preferably from 20 to 500% of a depth of the toner layer. When less than 20%, the toner is not smoothly discharged. When greater than 500%, excessive feeding or a blow up of the toner powder occurs in the container. An inflation degree of the toner layer (increase in volume of the toner cloud) in the weighing tank is preferably from 25 to 600% of a depth of the toner layer. In addition, as means of increasing a powder density of the fluidized toner layer, the powder can be fed in a divided pulsed form by intermittently feeding air from a divided porous air slider.

The powder filling apparatus in FIG. 1 can be used in a toner manufacturing, storage and shipping facility or near a copier in an office. When the apparatus is used near a copier, the apparatus is preferably located with a pressure vessel as an air supply source on a carriage, and in addition, a compressor storing compressed air in the pressure vessel can be attached thereto.

Figure 8:
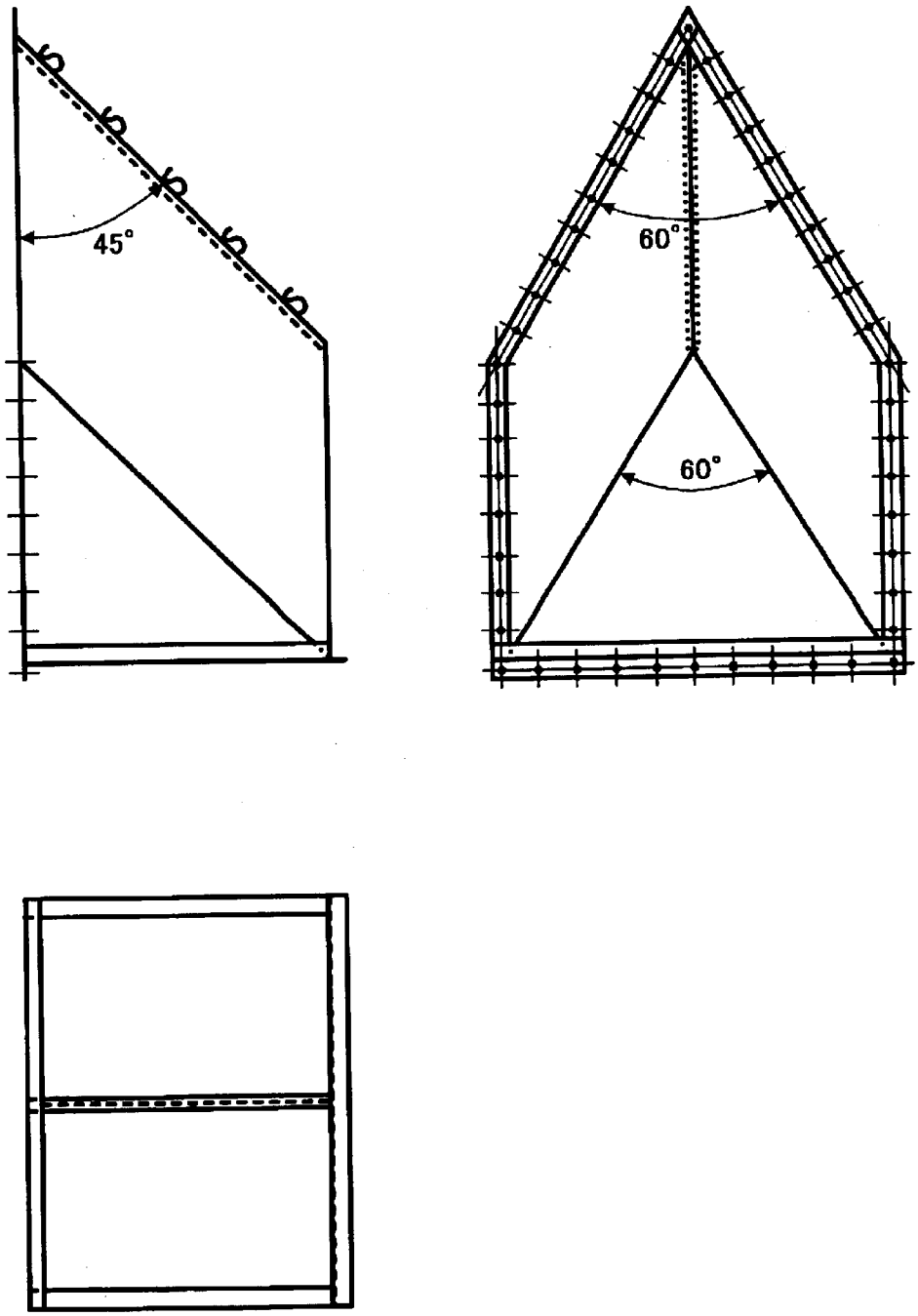
FIG. 8 is a schematic view illustrating another embodiment of the filling apparatus of the present invention.

A shape and material of the first container 10 are shown in FIG. 8. The first container 10 has a capacity of from 25 to 500 l, and typically has a toner containing capacity of from 10 to 200 kg. The first container 10 preferably has a bottom having a gradient angle of from 30 to 60°, and the connector 20 is preferably fixed to the first container at a gradient angle of from 30 to 60°.

The weighing tank 30 has a capacity of from 0.5 to 20 l, and it is preferable that the tank typically has a toner containing capacity of from 50 to 2,000 g. A two-component non-magnetic (color or monochrome) toner, a one-component non-magnetic (color or monochrome) toner, a one-component magnetic (monochrome) toner, a ferrite carrier developer and a magnetite carrier developer can be used in the apparatus. The apparatus starts fluidizing the toner at an air pressure from 3 to 5 kg/cm$^2$ and an air feeding amount of 0.1 to 1 liter/min, and the fluidization typically becomes stable in 5 to 20 sec.

As previously mentioned, feeding air into the weighing tank 30 further stabilizes (fixes) an air content (a ratio between a solid content and air).

The discharge control member 32*d* preferably has an outer diameter of from 5 to 50 mm, and the elastic ring 32*a* preferably has an inner diameter of from 5 to 50 mm. A difference between the outer diameter of the discharge control member and the inner diameter of the elastic ring 32*a* is typically from −0.5 to +2.0 mm.

Figure 9:
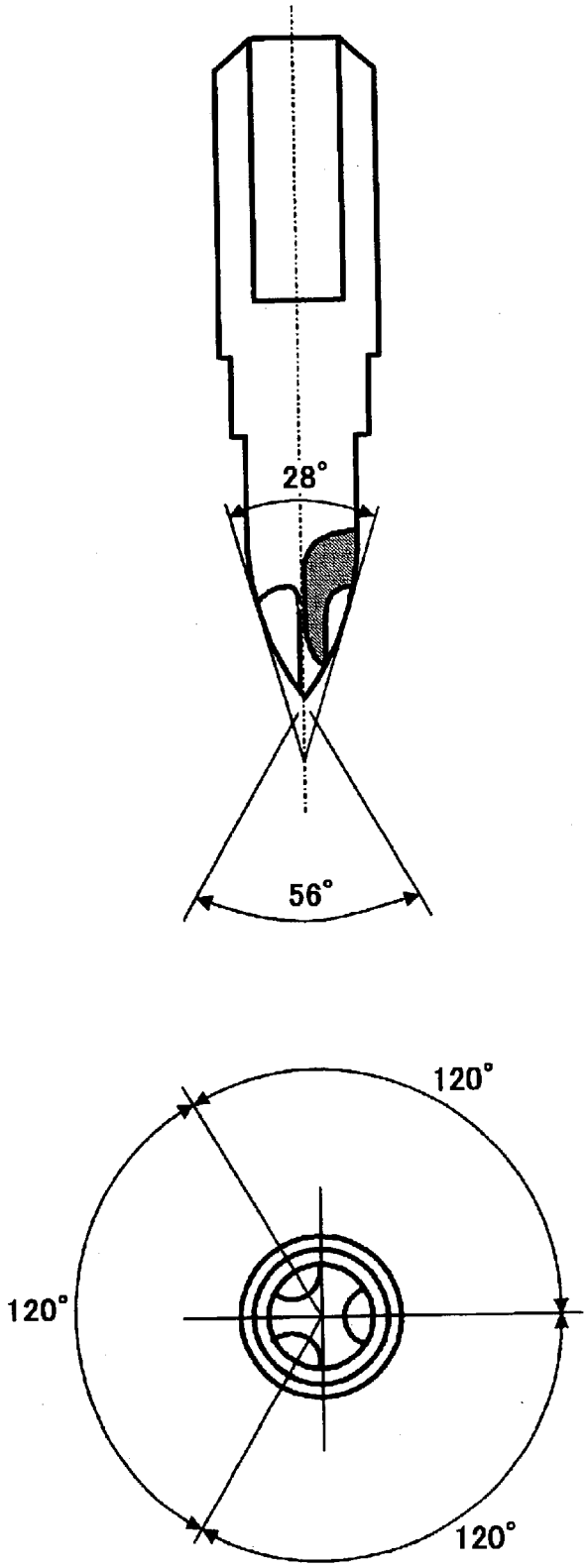
FIG. 9 is a schematic view illustrating an embodiment of the discharge regulation member of the present invention.

A shape and material of the discharge control member 32*d* are specifically shown in detail in FIG. 9. When the discharge control member 32*d* is lifted, a clearance between the elastic ring 32*a* and the discharge control member 32*d* expands and the toner starts falling to fill the small container 40.

The discharge opening 31 is opened or closed by inserting or releasing the discharge control member 32*d* into or from the elastic ring 32*a*. Typically, in the first stage, when an insertion level of the discharge control member 32*d* into the elastic ring 32*a* is from 0 to 10%, an opening of the discharge opening 31 is from 95 to 100%. In the second stage, when the insertion level is 40 to 60%, the opening is 5 to 30%. In the third stage, when the insertion level is 95 to 100%, the opening is 0 to 5%.

In the first stage, almost all of a specified amount of the toner is filled in the small container 40. In the second stage, the toner is precisely filled therein until the container is filled with the specified amount of the toner. In the third stage, when the container is filled with the specified amount of the toner, toner feeding is stopped.

Figure 10:
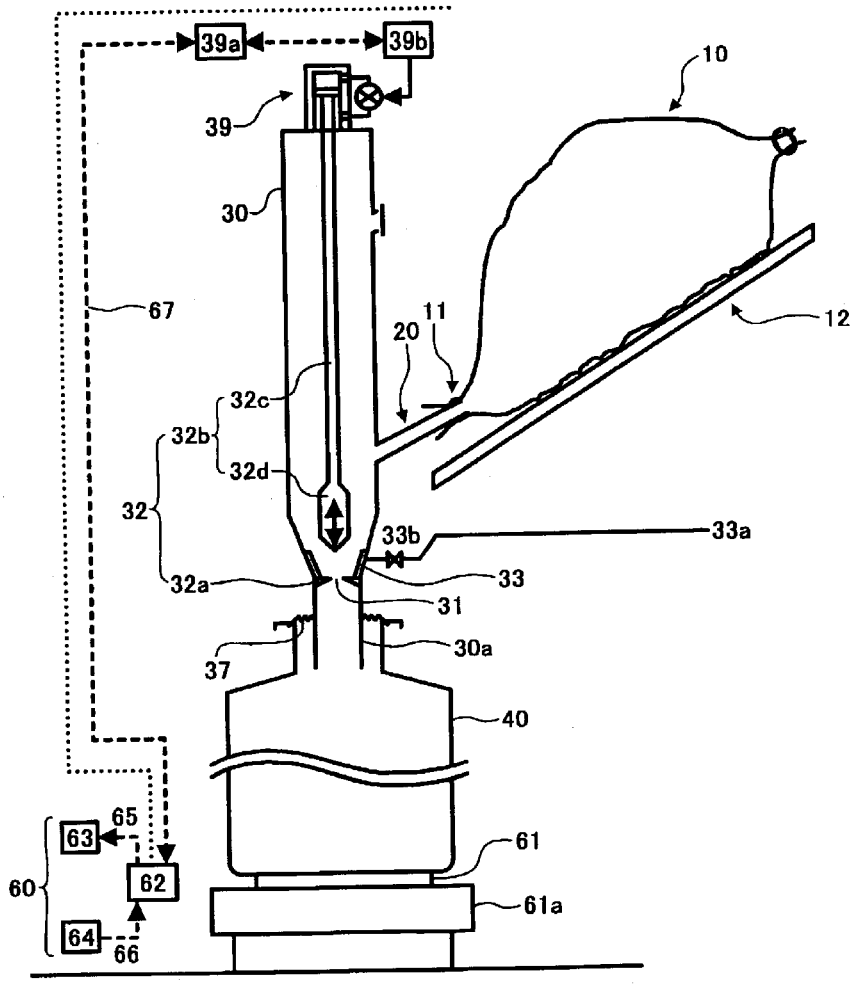
FIG. 10 is a schematic view illustrating the cross section of another embodiment of the filling apparatus of the present invention.

FIG. 10 is a schematic view illustrating the cross section of another embodiment of the filling apparatus of the present invention. In FIG. 10, a microscopic powder toner in a first container made of a plastic film bag 10 is filled into a second container 40 through a weighing tank 30. The first container 10 and the weighing tank 30 are connected to each other through a hole 11 of the plastic film bag, i.e., the first container and a connector 20 of the weighing tank 30. The weighing tank 30 has a filling amount regulator at a discharge opening thereof to fill the second container with a predetermined amount of the toner, which opens and closes the discharge opening 31.

The first container 10 needs to have a strength so as not to cut or break due to a weight of the toner contained therein, and a thickness (softness) so as to be easily handled (such that an opening of the bag can easily be tied or wrung). For example, the first container preferably has a thickness of from 30 to 200 μm. The first container made of a bag is hung above the filling apparatus or is located on an inclined plate 12 formed above the apparatus.

Figure 11:
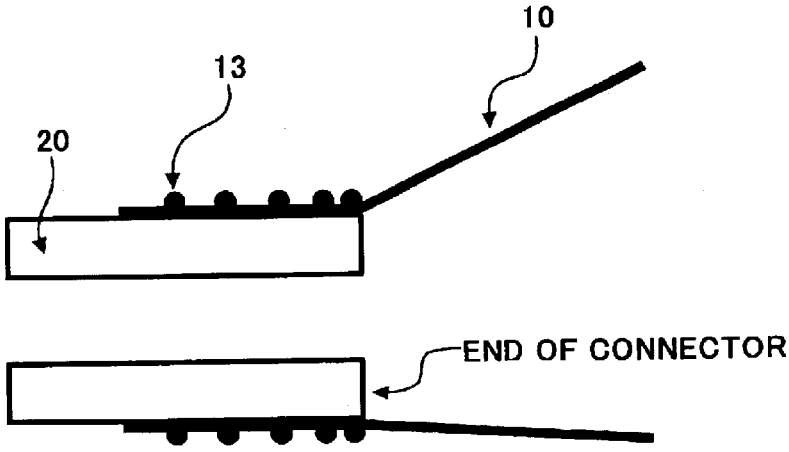
FIG. 11 is a schematic view illustrating the cross section of a connected part of a large bag container and a connector in FIG. 10.

As FIG. 11 shows, the first bag container 10 is easily connected to the connector with a lashing 13 such as a rubber band. When an end of the connector almost aligns with a location of the hole of the bag, the residual toner in the first bag container 10 can be minimized in filling the second container 40 with the toner.

Figure 12:
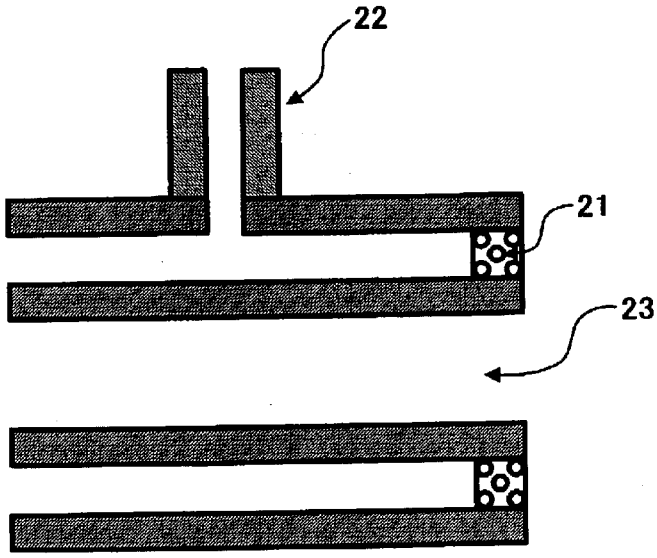
FIG. 12 is a schematic view illustrating the cross section of an embodiment of the connector of the present invention.

As FIG. 12 shows, the connector 20 has an air discharge member 21 fluidizing the toner in the first bag container 10 and feeding the toner into the weighing tank 30 through an inside 23 of an air intake tube 22.

A discharge amount of the toner fed in the weighing tank 30 is controlled by opening and closing a discharge opening 31 and a predetermined amount of the toner is filled in the second container 40.

The powder filling apparatus in FIG. 10 has the following specifications:

a capacity of the first container 10: 40 to 50 l a toner amount: 10 to 15 kg a filling method: fluidizing the toner and the toner falls by gravitation the toner: a two-component non-magnetic color toner, a one-component non-magnetic color toner, a one-component non-magnetic black toner and/or a one-component magnetic black toner fluidizing time: 5 to 15 min a shape of the first container 10: a flat bag or a tapered bag fluidizer: a porous resin material having a hole diameter of 2 to 15 μm, a porosity of 30% and a thickness of 5 mm feeding amount of air: 1 to 5 l/min.

The uniformity of the fluidization is visually observed, and can also be observed by a light transmittance with optical means. The second container 40 having an internal volume of 400 $cm^3$ can be filled with the toner in 7 to 20 sec and a release or a sinkage of an external additive can be prevented.

Figure 13:
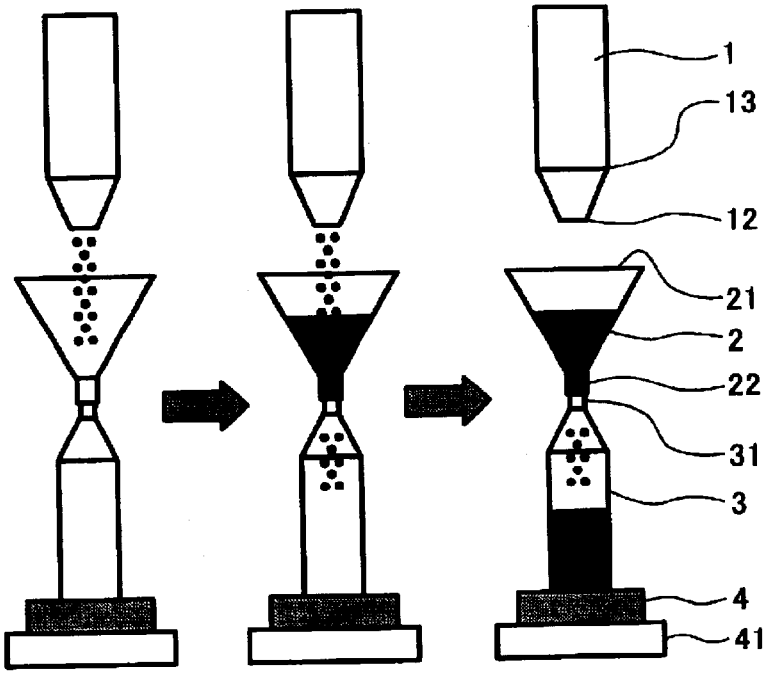
FIG. 13 is a schematic view illustrating a principle of the present invention, which illustrates a relationship among a container, a funnel and a powder at different time intervals, time and a method of filling powder of the present invention.

FIG. 13 is a schematic view illustrating a principle of the present invention, which represents a relationship among a container, a funnel and a powder over a time interval, and a method of filling powder of the present invention. In FIG. 13, a filling powder is supplied from a powder weighing tank 1 to a powder filling funnel 2 which is installed or set at a filling opening 31 of a powder container 3 (FIG. 1(A)). When the powder is ultra-fine particles such as a toner, it is difficult to quickly fill the powder container 3 with the powder because the particles do not easily slide on a contact slope and do not have sufficient fluidity when the particles contact to each other. In addition, the powder has to be carefully handled because the powder easily scatters. Therefore, the filling opening 31 of the powder container 3 and a powder discharge portion 22 of the powder filling funnel 2 are sealed such that the powder does not escape with the air leaked therefrom. Further, the powder discharge portion 22 has to have a specified diameter to prevent the powder from abruptly discharging into the powder container 3.

The powder supplied to the powder filling funnel 2 is partly filled in the powder container 3 and partly remains in the powder filling funnel 2 (FIG. 1(B)). The filling speed is not high due to the air remaining in the powder container 3.

The powder amount present in both the powder filling funnel 2 and the powder container 3 is simultaneously weighed without interrupting the filling operation. The powder container 3 is quickly and precisely filled with the powder by comparing total empty weight of the powder filling funnel 2 and the powder container 3 with the powder amount present therein and the total empty weight thereof (FIG. 1C)).

In addition, based on the recognized filling powder amount, an additional filling amount which is a shortage from a target filling amount is filled at a fine-tuned refilling rate to precisely refill the target filling amount. Therefore, an additional amount filling device is separately arranged from the powder filling funnel 2, which fills a certain amount of the additional filling amount at a fine-tuned filling rate. For example, an amount which is not over or rather slightly less than the predetermined filling amount is supplied to the powder filling funnel 2, and the additional amount filling device adds a small amount of the shortage at a slow speed and fine-tuned rate while the powder remains on the powder filling funnel 2.

In addition, the powder container 3 is preferably deaerated by force with a deaerator to fill the container with the powder more smoothly, which makes the bulky powder mixed with air in the powder container 3 compact to obtain a space in which the subsequent powder can be contained.

Figure 14:
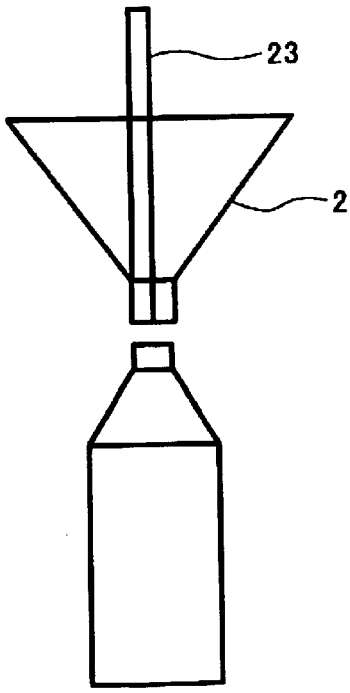
FIG. 14 is a schematic view illustrating an embodiment of the funnel installed in the filling apparatus of the present invention.

For example, as means of forcible deaeration, as shown FIG. 14, the funnel 2 having a release tube 23 to automatically release the air in the container can be used. In addition, a suction tube can be formed in the additional amount filling device.

Figure 15:
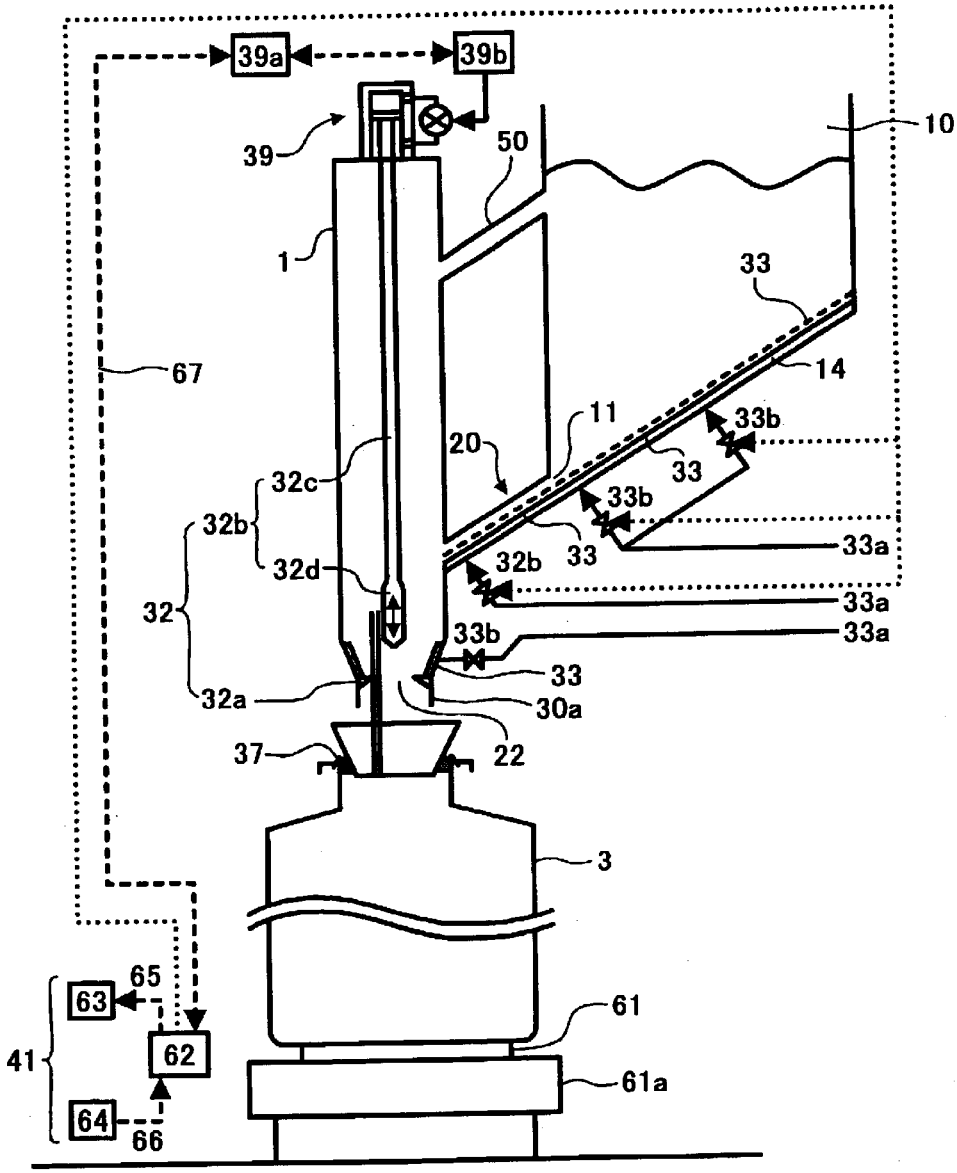
FIG. 15 is a schematic view illustrating the cross section of another an embodiment of the filling apparatus of the present invention.

In the filling apparatus of FIG. 15, a microscopic powder toner in a first container 10 is filled into a powder container 3 through a powder weighing tank 1. The first container 10 and the weighing tank 1 are connected to each other with a connector 20 between a toner discharge opening 11 and a toner entrance of the weighing tank 10. The weighing tank 10 has filling amount regulator 32 filling the powder container 3 with a predetermined amount of the toner from a funnel 2 at a toner discharge opening 22 thereof while opening and closing the opening 22.

The funnel 2 preferably has a light transmittance such that whether the powder therein is discharged into the powder container 3 can be identified from outside, and has a powder discharge portion 22 capable of fitting to a filling opening 31 of the powder container 3.

The first container 10 has a sloped inner wall 14 to aid in a discharge of the toner stored inside to the toner discharge opening 11. In this embodiment, the sloped inner wall 14 is a part of a hopper-shaped construction 13 at the bottom of the first container 10.

The first container 10 and the weighing tank 1 are also connected to each other with an upper connector 50 above the connector 20, which has a slope upward from the weighing tank 1 to the first container 10. The upper connector 50 keeps a pressure in the weighing tank 1 equal to that of the first container 10, and when a larger toner cloud than desired is formed, the excessive air can be extracted from the weighing tank 1 into the first container 10 through the upper connector 50. Since the upper connector 50 has a slope upward, the toner accompanied with the air can be returned into the weighing tank 1.

The toner powder discharged from the toner discharge opening 11 on the bottom of the first container 10 passes through the connector 20 into the weighing tank 1. The connector has an air slider formed of a perforated plate, i.e., the second toner fluidizer 33 at least on the bottom surface, which feeds air almost all over the surface in the long direction. The air fed from the second toner fluidizer 33 fluidizes the toner fed through the connector 20 into the weighing tank 1. The connector has a slope downward to the weighing tank 1 and helps the fluidized toner falling into the weighing tank 1.

The toner powder discharged from the toner discharge 20 opening 11 is fed into the weighing tank 1 through the connector 20. The weighing tank 1 in this embodiment may have the filling amount regulator 32 to precisely and smoothly fill a desired amount of the toner at the toner discharge opening 22. The desired amount can optionally be adjusted.

The filling amount regulator 32 in this embodiment is formed of a elastic ring 32*a* forming the discharge opening 22 and a discharge controller 32*b* controlling discharge of the toner from the discharge opening 22. The discharge controller 32*b* is formed of a discharge control member 32*d* fixed on a discharge control rod 32*c* reciprocating in the weighing tank 30. The discharge control member 32*d* is a conical member inserted into and released from the discharge opening 22 to open and close. An opening and closing degree of the discharge opening 22 depends on an inserting degree of the conical discharge control member 32*d* fixed on the discharge control rod 32*c* reciprocating in the weighing tank 1 into the discharge opening 22 formed by the elastic ring 32*a*.

When a conical tip having a small diameter of the discharge control member 32*d* ascends until the tip is completely released from the discharge opening 22, the discharge opening 22 is fully opened, i.e., the toner is freely discharged. When a root of the conical discharge control member 32*d* having a large diameter descends until the root is completely inserted into the discharge opening 22, the discharge opening 22 is completely closed, i.e., the toner discharge stops. When the conical discharge control member 32*d* is not completely released from the discharge opening 22 and not completely inserted thereinto, i.e., when the member is inserted thereinto such that there is a clearance between the member and the opening, the discharge opening 22 is half or partly opened according to the insert level, i.e., the toner is partially discharged. A flexible covering member 37 is located on a sleeve 30*a* of the discharge opening 22, however this covering member 37 can be omitted.

As shown in FIG. 15, the closer to the discharge opening 22, the thinner the thickness of the elastic ring 32*a* having a wedge-shaped cross section. The thinner part thereof, which has more flexibility, contacts the discharge control member 32*d* when completely inserted thereinto. The elastic ring 32*a* does not cause toner to film over a surface thereof and of the discharge control member 32*d*. It is thought that a stress is scarcely given to the toner inevitably remained between the elastic ring 32*a* and the discharge control member 32*d* even when they are contacted to each other.

However, the filling amount regulator at the discharge opening 22 in the weighing tank 1 is not required. For example, the discharge opening 22 can be formed of an elastic material and a plate member can be used as an openness regulation member, which is adjacent to the discharge opening 22 and slides ahead and backward in plane direction. In addition, a relative location between the discharge opening 22 and a movable member having an opening conformed to the opening thereof can control the openness.

A drive unit 39 driven by a driving source 39*b* controlled by a driving control apparatus 39*a* reciprocates the discharge control rod 32*c*. An air pressure cylinder, a motor, a hydraulic cylinder, etc. can be used as the drive unit 39. An air pressure cylinder is used in this embodiment. A source piping for a compressed air used for the first toner fluidizer 33 can distribute the compressed air to the driving source 39*b* to drive the drive unit 39.

The first toner fluidizer 33 has one or more pores discharging air and a first air lead-in tube 33*a* leading the compressed air into a porous material disposed therein. In this embodiment, a porous sinter having a smooth surface is used. In addition, this embodiment of the powder filling apparatus has a discharger (not shown) to eliminate static electricity to prevent a toner dust explosion.

As shown in FIG. 15, the first toner fluidizer 33 is formed in a whole circumference close to the discharge opening 22 in the weighing tank 1 to obtain a desired toner dischargeability, which is different from the partially formed thin-stripe toner fluidizer 33 in the first container 10. A moving amount of the toner powder has a range in proportion to a feeding amount of air, and the moving amount of the toner can be adjusted by controlling the feeding amount of air. However, when a similar air discharging material is used, an area size of each toner fluidizer 33, i.e., the number of holes of each toner fluidizer largely depends on an available amount of the air. Particularly, the weighing tank 1 having a smaller cross section toward the discharge opening 22 can circumferentially have several continuous stages of air feeding opening or have such a feeding structure as can feed air in a spiral direction.

The first air lead-in tube 33*a* has a first air feeding control valve 33*b* positionable to stop feeding air, start feeding air and control an amount of the feeding air. In the present invention, at least one of the air lead-in tubes 33*a* preferably has such an air feeding control valve.

In addition, the weighing tank 1 of the filling apparatus of the present invention can have pressure controller increasing and decreasing an inside pressure. The first container 10 can have such pressure controller instead of the weighing tank 30 or together therewith. Such a pressure controller controls an inside pressure and/or a toner cloud in the first container 10 and/or the weighing tank 1 into which air is fed from the above-mentioned first to third toner fluidizers.

Further, the filling apparatus of the present invention can include a suction tube 23 inserted into the powder container 3 to extract air therein filled with the toner. The powder discharge portion of the funnel 2 is a hollow tube and the release tube 23 is inserted into the powder container 3 therefrom. The release tube 23 is integral with the funnel 2 such that the tube is released from and inserted into the opening 31 of the powder container 3 to release the air therein from a tip of the tube. The inserted tip of the release tube 23 has a mesh material through which the air, but not the toner particles, can pass.

In addition, the powder filling apparatus of the present invention preferably has a filled toner weigher weighing the filled powder toner in the powder container 3, and the filled toner weigher 41 in this embodiment has a load cell 61 weighing the filled toner weight in the powder container 3 thereon. The load cell 61 is located on a lifter 61*a* changing a distance between the weighing tank 1 and the powder container 3 while lifting and lowering the load cell. The load cell 61 has monitor 63 displaying a weight of the filled powder toner.

As such a monitor, known displays such as pressure detector detecting a voltage changed according to an elastic deformation degree due to a weight or a pressure or a pressure detection device such as a piezoelectric device directly changing an electromotive force according to a pressure, can be used. Filling or stopping filling the toner can be made while seeing a filled amount (weight) of the toner displayed on the monitor 63.

The filled toner weigher 60 optionally has a processor 62 computing the filled toner weight from a difference between an empty total weight of the powder container 3, filling funnel 2 and suction tube 23 and a gross weight thereof filled with the toner.

The processor 62 has input device 64 in which a predetermined filling weight of the toner can be input and can change the predetermined filling weight thereof while seeing the weight displayed on the monitor 63. In addition, the processor 62 sends a drive instruction signal to the driving control apparatus 39*a* controlling the driving source 39*b* of the driving apparatus 39 based on a result of the computation, and the driving control apparatus 39*a* reciprocates the discharge control rod 32*c* based on the instruction. The processor 62 can include various CPUs from a simple analog voltage comparator to a microcomputer chip. When the analog voltage comparator is used, an AD converter converts an analog signal into a digital signal, e.g., a pulse signal corresponding to a difference of a predetermined potential.

As mentioned above, when a conical tip having a small diameter of the discharge control member 32*d* of the discharge control rod 32*c* ascends until the tip is completely released from the discharge opening 31, the discharge opening 31 is fully opened. When a root of the conical discharge control member 32*d* having a large diameter descends until the root is completely inserted into the discharge opening 31, the discharge opening 31 is completely closed. When the conical discharge control member 32*d* is not completely released from the discharge opening 31 and not completely inserted thereinto, i.e., when the member is inserted thereinto such that there is a clearance between the member and the opening, the discharge opening 31 is half or partially opened according to the insert level. Therefore, it can be adjusted to provide any level. However, the discharge control rod 32*c* of the embodiment of the powder filling apparatus shown in FIG. 15 has three reciprocation degrees, i.e., a completely closed degree, a fully opened degree and a half or partially opened degree which is in the middle therebetween since controlling an amount of feeding air to the first to third air lead-in tubes 33*a* also can control filling.

The input device 64 in this embodiment is a button-and-dial digital switch as a (binary) code generator. When the processor 62 is a CPU with a keyboard, a RAM rewritably storing various data including a weight based on a result of the computation and/or an input signal from the input device, i.e., calling the data in the CPU, computing and storing again a result of the computation and a ROM storing various programs including a processing program for processing the data and various instructing programs, can be installed in the processor 62. Then, the processor 62 can be configured, e.g., so as to have a program sending an opening and closing instruction to each of the air feeding control valves 33*b*.

Figure 16:
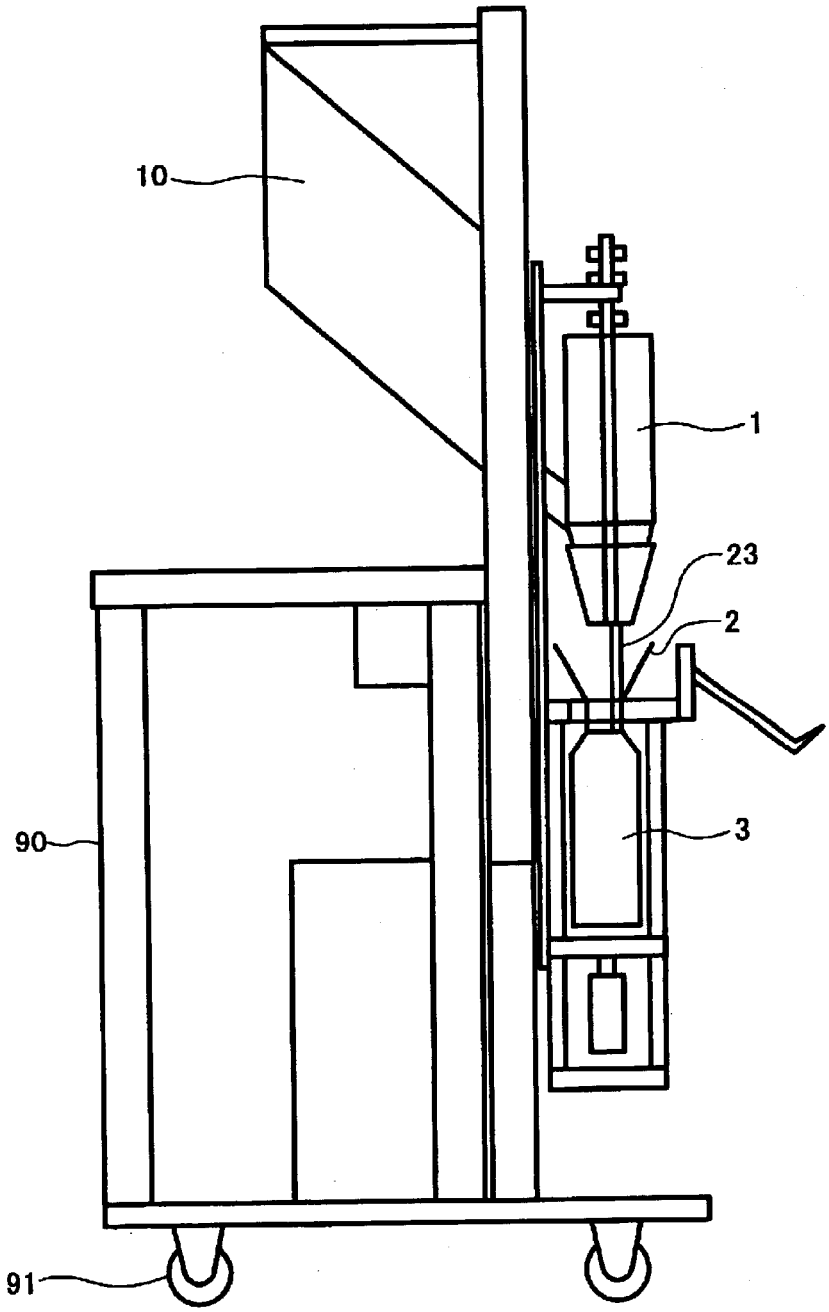
FIG. 16 is a schematic view illustrating another embodiment of the filling apparatus of the present invention.

As shown in FIG. 16, the apparatus of the present invention can be transportable when disposed on a carrier 90 including one or more castors 91.

This document claims priority and contains subject matter related to Japanese Patent Applications Nos. 2002-020980, 2002-320749 and 2002-320632 filed on Jan. 30, 2002, Nov. 5, 2002 and Nov. 5, 2003, respectively, the entire disclosures of which are incorporated herein by reference.

Having now fully described the invention, it will be apparent to one of ordinary skill in the art that many changes and modifications can be made thereto without departing from the spirit and scope of the invention as set forth herein.

What is claimed is:

1. A powder filling apparatus comprising:

a first container configured to contain a powder;

a weighing tank configured to receive the powder from the first container and discharge a predetermined amount of the powder to a second container, comprising:

an opening configured to discharge the powder into the second container; and a regulator configured to open and close the opening to discharge the predetermined amount of the powder into the second container, the regulator comprising a discharge control member and a ring, the ring having a first portion thinner than a second portion which is configured to form a seal with the discharge control member; and a connector configured to feed the powder from the first container into the weighing tank.

2. The powder filling apparatus of claim 1, wherein the powder is a toner powder.

3. The powder filling apparatus of claim 1, wherein the first container comprises a flexible plastic bag.

4. The powder filling apparatus of claim 3, wherein the flexible plastic bag has a thickness of from 30 to 200 $\mu$m.

5. The powder filling apparatus of claim 3, wherein the flexible plastic bag comprises one of a flat bag and tapered bag.

6. The powder filling apparatus of claim 3, wherein the flexible plastic bag is hooked on the apparatus.

7. The powder filling apparatus of claim 3, further comprising:

an inclined plate, wherein the flexible plastic bag is located on the inclined plate.

8. The powder filling apparatus of claim 1, wherein the connector comprises a porous member from which air is discharged.

9. The powder filling apparatus of claim 1, wherein an end of the connector connected with the first container is located at a position substantially the same as a mounting position of the first container.

10. The powder filling apparatus of claim 1, wherein the connector is separable into a first part connected with the first container and a second part connected with the weighing tank.

11. The powder filling apparatus of claim 1, further comprising:

a deaerator configured to deaerate at least one of the first container and the connector.

12. The powder filling apparatus of claim 11, wherein the deaerator is provided on the first container.

13. The powder filling apparatus of claim 11, wherein the deaerator is provided on the connector.

14. The powder filling apparatus of claim 1, further comprising:

an aerator configured to aerate the first container when the powder is fed into the weighing tank.

15. The powder filling apparatus of claim 14, wherein the aerator starts aeration when the powder is fed into the weighing tank and stops the aeration when a surface of the powder reaches a predetermined position in the weighing tank.

16. The powder filling apparatus of claim 14, wherein the aerator aerates with dehumidified air.

17. The powder filling apparatus of claim 8, wherein the porous member is formed on an end of the connector connected with the first container.

18. The powder filling apparatus of claim 8, wherein the porous member is formed on a bottom surface of the connector.

19. The powder filling apparatus of claim 1, wherein the regulator is positionable to provide at least three levels of discharging including a free discharge, a stopped discharge and a partial discharge of the powder.

20. A powder filling apparatus comprising:

a first container configured to contain a powder;

a weighing tank configured to receive the powder from the first container and discharge a predetermined amount of the powder to a second container, comprising:

an opening configured to discharge the powder into the second container; and a regulator configured to open and close the opening to discharge the predetermined amount of the powder into the second container; and a connector configured to feed the powder from the first container into the weighing tank, wherein the weighing tank comprises a powder fluidizer configured to fluidize the powder fed from the weighing tank to the second container through the opening.

21. The powder filling apparatus of claim 1, wherein the connector comprises a powder fluidizer configured to fluidize the powder fed from the first container through the connector.

22. The powder filling apparatus of claim 1, wherein the first container comprises an inclined inner wall.

23. The powder filling apparatus of claim 22, wherein the first container comprises a hopper-shaped structure in a lower part thereof, and wherein the inclined inner wall comprises a part of the hopper-shaped structure of the first container.

24. A powder filling apparatus comprising:

a first container configured to contain a powder;

a weighing tank configured to receive the powder from the first container and discharge a predetermined amount of the powder to a second container, comprising:

an opening configured to discharge the powder into the second container; and a regulator configured to open and close the opening to discharge the predetermined amount of the powder into the second container; and a connector configured to feed the powder from the first container into the weighing tank, wherein the first container comprises an inclined inner wall, and wherein the inclined inner wall comprises a valley having a shallow slope, and wherein the valley comprises a powder fluidizer configured to accelerate fluidization of the powder.

25. The powder filling apparatus of claim 21, further comprising an upper connector located above the connector, wherein the first container and weighing tank are connected to each other with the upper connector.

26. A powder filling apparatus comprising:

a first container configured to contain a powder;

a weighing tank configured to receive the powder from the first container and discharge a predetermined amount of the powder to a second container, comprising:

an opening configured to discharge the powder into the second container; and a regulator configured to open and close the opening to discharge the predetermined amount of the powder into the second container; and a connector configured to feed the powder from the first container into the weighing tank, wherein the regulator comprises an elastic ring having the opening and a discharge controller configured to control discharging the powder from the opening, wherein the discharge controller comprises a discharge control rod reciprocating in the weighing tank and a discharge control member fixed on the discharge control rod, and wherein the discharge control member comprises a conical member configured to be inserted into and released from the opening to control discharging the powder.

27. The powder filling apparatus of claim 26, wherein an open area of the opening is adjusted by controlling an insertion level of the conical member into the opening of the elastic ring.

28. The powder filling apparatus of claim 26, further comprising:

a drive unit configured to reciprocate the discharge control rod.

29. A powder filling apparatus comprising:

a first container configured to contain a powder;

a weighing tank configured to receive the powder from the first container and discharge a predetermined amount of the powder to a second container, comprising:

an opening configured to discharge the powder into the second container; and a regulator configured to open and close the opening to discharge the predetermined amount of the powder into the second container;

a connector configured to feed the powder from the first container into the weighing tank; and a suction tube configured to extract air in the second container, wherein the suction tube has an insertion opening comprising a mesh material passing air without passing the powder.

30. The powder filling apparatus of claim 20, wherein the powder fluidizer comprises a porous material and an air intake tube configured to lead compressed air into the porous material.

31. The powder filling apparatus of claim 24, wherein the powder fluidizer comprises a porous material and an air intake tube configured to lead compressed air into the porous material.

32. The powder filling apparatus of claim 25, wherein the powder fluidizer comprises a porous material and an air intake tube configured to lead compressed air into the porous material.

33. The powder filling apparatus of claim 30, wherein the air intake tube comprises an air feeding control valve configured to start and stop feeding air, and control an amount of the feeding air.

34. The powder filling apparatus of claim 31, wherein the air intake tube comprises an air feeding control valve configured to start and stop feeding air, and control an amount of the feeding air.

35. The powder filling apparatus of claim 32, wherein the air intake tube comprises an air feeding control valve configured to start and stop feeding air, and control an amount of the feeding air.

36. The powder filling apparatus of claim 31, wherein the connector comprises a downslope through which the powder fluidized by the air discharged from the air intake tube is fed into the weighing tank.

37. The powder filling apparatus of claim 32, wherein the upper connector comprises an upslope through which the air led by the air intake tube is evacuated into the first container through the weighing tank.

38. The powder filling apparatus of claim 1, wherein at least one of the first tank and the weighing tank further comprises an inner pressure controller configured to increase and decrease the inner air pressure therein.

39. The powder filling apparatus of claim 28, further comprising a filled powder weight controller configured to control a weight of the powder in the second container.

40. The powder filling apparatus of claim 39, wherein the filled powder weight controller comprises a load cell configured to measure a filled powder weight.

41. The powder filling apparatus of claim 40, further comprising:

a monitor configured to display the filled powder weight weighed by the load cell.

42. The powder filling apparatus of claim 40, wherein the filled powder weight controller further comprises a processor configured to compute the filled powder weight from a difference between an empty weight of the second container and a gross weight of the second container filled with the powder.

43. The powder filling apparatus of claim 42, wherein the processor comprises an input device configured to input and change a filling weight of the powder to be contained in the second container.

44. The powder filling apparatus of claim 42, further comprising:

a drive controller controlling the drive unit, wherein the processor sends a drive signal to the drive controller.

45. The powder filling apparatus of claim 42, further comprising:

a first air feeding control valve configured to start and stop feeding air, and control an amount of feeding air into the weighing tank;

a second air feeding control valve configured to start and stop feeding air, and control an amount of feeding air into the connector; and a third air feeding control valve configured to start and stop feeding air, and control an amount of feeding air into the first container, wherein the processor sends an opening or closing signal to at least one of the first, second and third air feeding control valves.

46. A powder filling apparatus comprising:

a first container configured to contain a powder;

a weighing tank configured to receive the powder from the first container and discharge a predetermined amount of the powder to a second container, comprising:

an opening configured to discharge the powder into the second container; and a regulator configured to open and close the opening to discharge the predetermined amount of the powder into the second container;

a connector configured to feed the powder from the first container into the weighing tank;

a support configured to support the second container, comprising:

a filled powder weighing device configured to control a weight of the powder container; and an inner air remover configured to remove air from the powder contained in the second container, and a funnel comprising a powder discharge portion which is configured to fit an opening of the second container with substantially no space therebetween and through which the powder is discharged from the weighing tank to the second container, wherein the opening of the weighing tank comprises a powder supply and stop device.

47. The powder filling apparatus of claim 46, wherein whether the powder in the funnel is discharged into the second container can be identified from outside, and the filled powder weighing device is configured to weigh a total empty weight of the funnel and the powder container, and a total weight of the funnel, the second container and the powder present in the funnel and the second container.

48. The powder filling apparatus of claim 46, wherein the powder supply and stop device is configured to stop or discharge the powder based on the total weight of the funnel, the second container and the powder present in the funnel and the powder container.

49. The powder filling apparatus of claim 46, further comprising an additional powder feeder configured to additionally feed the powder based on the total weight of (i) the funnel, the second container and the powder present in the funnel and (ii) the second container while the powder remains in the funnel, wherein the additional powder feeder has a lower powder feeding capacity than the funnel.

50. The powder filling apparatus of claim 46, wherein the inner air remover comprises a release tube configured to extend from an inside to an outside of the second container.

51. The powder filling apparatus of claim 50, wherein the release tube is located at a discharge portion of the funnel and is configured to release from and fit to the second container together with the funnel.

52. The powder filling apparatus of claim 50, wherein the release tube comprises a suction opening configured to be disposed in the second container, and wherein a position of the suction opening is configured to be movable.

53. The powder filling apparatus of claim 46, wherein the inner air remover comprises a powder surface compressor comprising a mesh configured to selectively remove air from inside of the second container.

54. A powder filling method comprising:

feeding a powder from a first container through a connector into a weighing tank comprising an opening and a regulator;

feeding the powder from the weighing tank to a second container; and controlling the open degree of the opening by forming a seal between a discharge control member and a first portion of a ring thinner than a second portion of the ring to fill the second container with a predetermined amount of the powder.

55. The powder filling method of claim 54, wherein controlling further comprises controlling the open degree of the opening to allow the opening to perform at least one of freely discharging, stopping discharging or partially discharging the powder.

56. The powder filling method of claim 54, further comprising:

fluidizing the powder fed from the weighing tank into the second container through the opening with a first powder fluidizer provided at the opening.

57. The powder filling method of claim 56, further comprising:

fluidizing the powder fed from the first container into the weighing tank through the connector with a second powder fluidizer.

58. The powder filling method of claim 54, further comprising:

fluidizing the powder in the first container by forming an inclined wall in the first container.

59. The powder filling method of claim 58, wherein the first container comprises a hopper-shaped structure in a lower part thereof, and wherein the inclined inner wall comprises a part of the hopper-shaped structure of the first container.

60. A powder filling method feeding a powder from a first container through a connector into a weighing tank comprising an opening and a regulator;

feeding the powder from the weighing tank to a second container;

controlling the open degree of the opening to fill the second container with a predetermined amount of the powder; and fluidizing the powder in the first container by forming an inclined wall in the first container, wherein the inclined inner wall comprises a valley having a shallow slope, and wherein the valley comprises the third powder fluidizer configured to accelerate and fluidize the powder.

61. A powder filling method comprising:

feeding a powder from a first container through a connector into a weighing tank comprising an opening and a regulator;

feeding the powder from the weighing tank to a second container;

controlling the open degree of the opening to fill the second container with a predetermined amount of the powder; and deaerating air in the weighing tank into the first container with an upper connector located above the connector.

62. The powder filling method of claim 54, wherein controlling further comprises controlling the open degree of the opening by inserting a conical member into or releasing from the opening.

63. The powder filling method of claim 54, wherein controlling further comprises controlling the open degree of the opening by extending or withdrawing a plate along the opening.

64. A powder filling method comprising:

feeding a powder from a first container through a connector into a weighing tank comprising an opening and a regulator;

feeding the powder from the weighing tank to a second container;

controlling the open degree of the opening to fill the second container with a predetermined amount of the powder; and driving the conical member with a drive unit, wherein controlling further comprises controlling the open degree of the opening by inserting a conical member into or releasing from the opening.

65. The powder filling method of claim 63, further comprising:

driving the plate with a drive unit.

66. A powder filling method comprising:

feeding a powder from a first container through a connector into a weighing tank comprising an opening and a regulator;

feeding the powder from the weighing tank to a second container;

controlling the open degree of the opening to full the second container with a predetermined amount of the powder; and extracting air in the second container with a suction tube, wherein the suction tube has an insertion opening comprising a mesh material through which air passes and powder does not pass.

67. The powder filling method of claim 56, wherein fluidizing the powder with the first powder fluidizer further comprises leading compressed air through a porous material of the first powder fluidizer.

68. A powder filling method comprising:

feeding a powder from a first container through a connector into a weighing tank comprising an opening and a regulator;

feeding the powder from the weighing tank to a second container; and controlling the open degree of the opening to fill the second container with a predetermined amount of the powder;

fluidizing the powder fed from the weighing tank into the second container through the opening with a first powder fluidizer provided at the opening; and fluidizing the powder fed from the first container into the weighing tank through the connector with a second powder fluidizer, wherein fluidizing the powder with the second powder fluidizer further comprises leading compressed air through a porous material of the second powder fluidizer.

69. The powder filling method of claim 68, wherein fluidizing the powder with the third powder fluidizer further comprises leading compressed air through a porous material of the third powder fluidizer.

70. The powder filling method of claim 67, wherein fluidizing the powder with the first powder fluidizer further comprises controlling the compressed air with an air feeding control valve.

71. The powder filling method of claim 68, wherein fluidizing the powder with the second powder fluidizer further comprises controlling the compressed air with an air feeding control valve.

72. The powder filling method of claim 69, wherein fluidizing the powder with the third powder fluidizer further comprise controlling the compressed air with an air feeding control valve.

73. The powder filling method of claim 54, wherein the connector comprises a downslope from the first container toward the weighing tank.

74. The powder filling method of claim 61, wherein the upper connector comprises an upslope from the weighing tank toward the first container.

75. The powder filling method of claim 54, further comprising:

controlling an inner air pressure in at least one of the first container and weighing tank.

76. The powder filling method of claim 66, further comprising:

weighing a filled powder weight in the second container.

77. The powder filling method of claim 76, wherein the weighing is performed with a load cell.

78. The powder filling method of claim 77, wherein weighing further comprises displaying the filled powder weight weighed by the load cell in a monitor.

79. The powder filling method of claim 76, wherein weighing further comprises weighing an empty weight of the second container and a gross weight of the second container filled with the powder.

80. The powder filling method of claim 79, wherein weighing further comprises inputting a filling weight of the powder to be contained in the second container in a processor, weighing the powder weight in the second powder container by weighing an empty weight of the second container and a gloss weight thereof filled with the powder, and determining a judging information based on whether the powder weight is the filling weight.

81. The powder filling method of claim 80, further comprising:

sending the judgment information to a drive controller to control the open degree of the opening.

82. The powder filling method of claim 80, further comprising:

fluidizing the powder with a powder fluidizer provided at the opening by leading compressed air;

controlling the compressed air with an air feeding control valve; and sending the judgment information to a controller to control an amount of the compressed air.

83. A powder filling method comprising:

weighing a total empty weight of a powder container and a funnel set on the powder container;

discharging a powder into the powder container through the funnel;

weighing a total weight of a powder, the powder container and the funnel while the powder remains in the funnel;

stopping the discharge of powder into the powder container by forming a seal between a discharge control member and a first portion of a ring thinner than a second portion of the ring; and comparing the total empty weight with the total weight to determine the powder weight before finishing filling the powder container with the powder.

84. The powder filling method of claim 83, further comprising:

discharging an additional amount of the powder to adjust the weight of the powder to be a target amount of the powder.

85. A powder filling method comprising:

weighing a total empty weight of a powder container and a funnel set on the powder container;

discharging a powder into the powder container through the funnel;

weighing a total weight of a powder, the powder container and the funnel while the powder remains in the funnel;

comparing the total empty weight with the total weight to determine the powder weight before finishing filling the powder container with the powder; and discharging an additional amount of the powder to adjust the weight of the powder to be a target amount of the powder, wherein discharging the additional amount of the powder is performed through a second funnel.

86. The powder filling method of claim 83, further comprising: forcibly deaerating the powder container.

87. A powder filling method comprising:

weighing a total empty weight of a powder container and a funnel set on the powder container;

discharging a powder into the powder container through the funnel;

weighing a total weight of a powder, the powder container and the funnel while the powder remains in the funnel;

comparing the total empty weight with the total weight to determine the powder weight before finishing filling the powder container with the powder; and deaerating air in the powder container using a tube provided on the funnel.

88. A powder filling method comprising:

weighing a total empty weight of a powder container and a funnel set on the powder container;

discharging a powder into the powder container through the funnel;

weighing a total weight of a powder, the powder container and the funnel while the powder remains in the funnel;

comparing the total empty weight with the total weight to determine the powder weight before finishing filling the powder container with the powder; and forcibly deaerating the powder container, wherein forcibly deaerating further comprises using a movable suction tube located separately from the powder container and the funnel.

* * * * *